US010753233B2

(12) United States Patent
Hong et al.

(10) Patent No.: US 10,753,233 B2
(45) Date of Patent: Aug. 25, 2020

(54) FLOW GUIDE STRUCTURE FOR CASING FLANGE, AND CASING AND TURBOMACHINE HAVING THE SAME

(71) Applicant: DOOSAN HEAVY INDUSTRIES & CONSTRUCTION CO., LTD, Changwon-si, Gyeongsangnam-do (KR)

(72) Inventors: Gi Won Hong, Changwon-si (KR); Chang Young Choi, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 128 days.

(21) Appl. No.: 15/802,226

(22) Filed: Nov. 2, 2017

(65) Prior Publication Data

US 2018/0128127 A1 May 10, 2018

(30) Foreign Application Priority Data

Nov. 4, 2016 (KR) ..... 10-2016-0146751

(51) Int. Cl.
*F01D 25/24* (2006.01)
*F01D 9/04* (2006.01)

(52) U.S. Cl.
CPC ..... *F01D 25/243* (2013.01); *F01D 9/041* (2013.01); *F05D 2260/97* (2013.01)

(58) Field of Classification Search
None
See application file for complete search history.

(56) References Cited

U.S. PATENT DOCUMENTS 1,957,699 A * 5/1934 Dahistrand ..... F01D 25/243 220/693
1,957,700 A * 5/1934 Dahlstran ..... F01D 25/243 285/41
2,276,603 A * 3/1942 Willis ..... F01D 25/243 52/467
6,273,675 B1 * 8/2001 Magoshi ..... F01D 25/12 415/180
8,511,985 B2 * 8/2013 Goßmann ..... F01D 25/243 415/214.1

(Continued)

FOREIGN PATENT DOCUMENTS

DE 102014224419 A1 6/2016
EP 1096111 A1 5/2001

(Continued)

OTHER PUBLICATIONS

JP2001003710 English translation, Ryutaro, Jan. 9, 2001.*

(Continued)

*Primary Examiner* — Christopher Verdier
*Assistant Examiner* — Jason A Fountain
(74) *Attorney, Agent, or Firm* — Invenstone Patent, LLC

(57) ABSTRACT

A flow guide structure for a casing flange, and a casing and a turbomachine having the same, include a flange portion connecting an upper casing and a lower casing and a flow guide positioned at the flange portion to guide fluid to flow close to the flange portion, whereby steam flow resistance is reduced around an inner casing flange of a turbine and the steam flow is smoothed.

3 Claims, 21 Drawing Sheets
(6 of 21 Drawing Sheet(s) Filed in Color)

(56) References Cited

U.S. PATENT DOCUMENTS

| | | | | |
|---|---|---|---|---|
| 9,200,595 | B2 * | 12/2015 | Bottome | F03D 1/0691 |
| 2012/0134844 | A1 * | 5/2012 | Bottome | F02K 3/06 416/245 R |

FOREIGN PATENT DOCUMENTS

| | | | |
|---|---|---|---|
| EP | 2538054 | A1 | 12/2012 |
| JP | 57-084304 | U1 | 5/1982 |
| JP | S59203811 | A | 11/1984 |
| JP | H0196312 | A | 7/1998 |
| JP | 2001003710 | A | 1/2001 |

OTHER PUBLICATIONS

Korean Office Action issued by the Korean Intellectual Property Office on Oct. 22, 2017 in connection with Korean patent application No. Oct. 2016-0146751.

An extended European search report issued by the European Patent Office on Jan. 4, 2018 in connection with European patent application No. 17200042.4.

* cited by examiner

FLOW GUIDE STRUCTURE FOR CASING FLANGE, AND CASING AND TURBOMACHINE HAVING THE SAME

CROSS-REFERENCE TO RELATED APPLICATIONS

This application claims priority to Korean Patent Application No. 10-2016-0146751, filed on Nov. 4, 2016, the disclosure of which is incorporated herein by reference in its entirety.

BACKGROUND

Exemplary embodiments of the present disclosure relate to a flow guide structure for a casing flange, and a casing and a turbomachine having the same, and more particularly, to a structure reducing steam flow resistance around a casing flange and smoothing steam flow.

Generally, a turbomachine is a power generation apparatus converting a thermal energy of fluid, such as gas, steam, and the like, into a rotating force being a mechanical energy. The turbomachine typically comprises a rotor having a plurality of buckets to perform shaft rotation by the fluid and a casing installed to surround the rotor and having a plurality of diaphragms.

Herein, a gas turbine includes a compressor section, a combustor, and a turbine section. External air is inhaled and compressed by rotation of the compressor section and then sent to the combustor, and burnt by a mixture of the compressed air and fuel in the combustor. A high temperature/high pressure of gas generated in the combustor rotates the rotor of the turbine while passing through the turbine section, and thus operates a generator.

In a steam turbine, a high-pressure turbine section, an intermediate-pressure turbine section, and a low-pressure turbine section are connected serially or in parallel to rotate a rotor. In the serially connected structure, the high-pressure turbine section, the medium-pressure turbine section, and the low-pressure turbine section share one rotor. Each of turbines in the steam turbine includes a bucket and a diaphragm around a rotor inside a casing, and steam rotates the rotor while passing through the bucket and the diaphragm to thus operate a generator.

In FIG. 1, an inner casing of a low-pressure turbine inside a steam turbine is shown. Power steam passes through a high-pressure turbine, an intermediate-pressure turbine, and a low-pressure turbine in order, and then finally flows toward a condenser positioned at a lower end portion of the low-pressure turbine. Accordingly, the power steam discharged through a diaphragm 2 of the low-pressure turbine moves in a direction of the lower end of the low-pressure turbine.

At this time, some steam positioned at the diaphragm 2 flows along a circumference of an outer side of the inner casing from an upward direction to a downward direction. The inner casing has a structure with an upper casing 3 and a lower casing 4 coupled by flanges 5*a*, 5*b*, respectively, and almost has a stepped shape in a direction of an outer side thereof.

Consequently, steam flowing along the circumference of the outer side of the low-pressure turbine receives flow resistance at the flanges 5*a*, 5*b* around a reference numeral X, as shown in FIG. 1 and FIG. 2. The steam moving in a downward direction along the circumference of the outer side of the upper casing receives flow resistance bent by a 90-degree angle at the flange 5*a* around a reference numeral Y, such that a fluid velocity largely reduces and a flow direction also experiences a rapid change. Further, some turbulence occurs at a lower end portion of the flange 5*b* stemming from the stepped shape of the flanges 5*a*, 5*b*.

SUMMARY OF THE INVENTION

TA resolution of the above problems of a conventional technology is disclosed to provide a structure reducing steam flow resistance around a casing flange and thus smoothing steam flow.

Other objects and advantages can be understood by the following description, and become apparent with reference to the embodiments of the present disclosure. The objects and advantages of the present disclosure can be realized by the means as claimed and combinations thereof.

An exemplary embodiment relates to a flow guide structure for a casing flange, and a casing and a turbomachine having the same, and may comprise a flow guide positioned to seal a flange portion connecting an upper casing and a lower casing and guiding fluid flow which flows close to the flange portion.

The flow guide may comprise a flat portion positioned close to the flange portion; an inclined portion bent at a predetermined angle and connected to an upper end of the flat portion, fixed to the upper casing, and guiding the fluid flow which flows in a top-down direction; and a bending portion bent at a lower end of the flat portion and fixed to the lower end of the flat portion.

Further, the flow guide may comprise a flat portion positioned close to the flange portion; an inclined portion bent at a predetermined angle and connected to an upper end of the flat portion, fixed to the upper casing, and guiding the fluid flow which flows in a top-down direction; and a slope portion bent at a predetermined angle and connected to a lower end of the flat portion, fixed to the lower casing, and preventing occurrence of turbulence of fluid guided by the inclined portion.

Further, the flow guide may comprise a guide wing portion positioned at the inclined portion and distributing the fluid flow, which flows in the top-down direction, to an outer side of the flange portion.

Further, the flow guide may comprise a buffering bar fixed to an inner surface of the inclined portion by a fastening pin, and wherein one end of the buffering bar is close to the inclined portion and other end of the buffering bar is bent close to the upper casing.

Further, the flow guide may comprise a supporting unit interposed between the inclined portion and the upper casing to support the inclined portion.

The supporting unit may comprise a first supporting member interposed between an upper end of an inner surface of the inclined portion and the upper casing, and wherein the first supporting member comprises a first upper side block positioned at the inner surface of the inclined portion; and a first lower side block fixed to the upper casing and positioned to contact with the first upper side block.

Further, the first supporting member may comprise a first inner housing formed inside the first upper side block and positioning a first guide protrusion at an opening side; a first elastic body positioned at the first inner housing and contacting with the first lower side block; and a first guide groove formed at an outer surface of the first lower side block and seating the first guide protrusion.

Further, the supporting unit may comprise a second supporting member interposed between a lower portion of the inner surface of the inclined portion and the upper casing, and wherein the second supporting member may comprise a second upper side block fixed to a second upper plate positioned at the inner surface of the inclined portion; and a second lower side block fixed to a second lower plate positioned at the upper casing and positioned to contact with the second upper side block.

Further, the second supporting member further may comprise a second inner housing formed inside the second upper side block and positioning a second guide protrusion at an opening side; a second elastic body positioned at the second inner housing and contacting with the second lower side block; and a second guide groove formed at an outer surface of the second lower side block and seating the second guide protrusion.

Further, the flow guide may comprise a flat portion positioned close to the flange portion; and a curved portion bent at a predetermined curvature and connected to an upper end and a lower end of the flat portion, fixed to the upper casing and the lower casing, and guiding fluid flow which flows in a top-down direction.

The flange portion may comprise a center flange connecting a center portion of the inner casing and a side flange connecting both end portions of the inner casing, and wherein the flow guide is positioned at the center flange.

A direction groove may be formed to be spaced apart from a predetermined interval at the outer side of the flow guide to guide fluid flow.

Further, the direction groove may comprise a vertical groove portion formed at an upper side of the flow guide and moving fluid in a downward direction; and a bending groove portion formed to connect with the vertical groove portion at a lower side of the flow guide and changing the fluid flow of moving in the downward direction.

Further, a plurality of the direction grooves may be positioned along a longitudinal direction of the flow guide; and bending angles between a plurality of the bending groove portions are different.

A direction hole may be formed to be spaced apart from a predetermined interval at the outer side of the flow guide to guide fluid flow.

Further, the direction hole may comprise a vertical hole portion formed at an upper side of the flow guide and moving fluid in a downward direction; and a bending hole portion formed to connect with the vertical hole portion at a lower side of the flow guide and changing the fluid flow of moving in the downward direction.

Further, a plurality of the direction holes may be positioned along a longitudinal direction of the flow guide and bending angles between a plurality of the bending groove portions are different.

A casing may comprise a upper casing comprising an upper of a turbomachine, positioning an upper flange at an outer side portion, and positioning a plurality of diaphragms in multiple columns with a plurality of vanes mounted on an inner surface; a lower casing comprising a lower of the turbomachine, positioning a lower flange at the outer side portion, and positioning by a plurality of diaphragms in multiple columns with a plurality of vanes mounted on the inner surface; and the flow guide structure for the casing flange positioned to surround the upper flange and the lower flange.

A turbomachine may comprise the casing; and a rotor positioned inside the casing and mounting a plurality of buckets with a plurality of vanes alternatively arranged.

Accordingly, it is possible to guide fluid flow around the casing flange and reduce flow resistance, thus smoothing the fluid flow and ultimately improving efficiency of the turbine.

It is to be understood that both the foregoing general description and the following detailed description disclosed herein are exemplary and explanatory and are intended to provide further explanation to what is claimed.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other objects, features and other advantages of the present disclosure will be more clearly understood from the following detailed description taken in conjunction with the accompanying drawings, in which.

DETAILED DESCRIPTION

Figure 1:
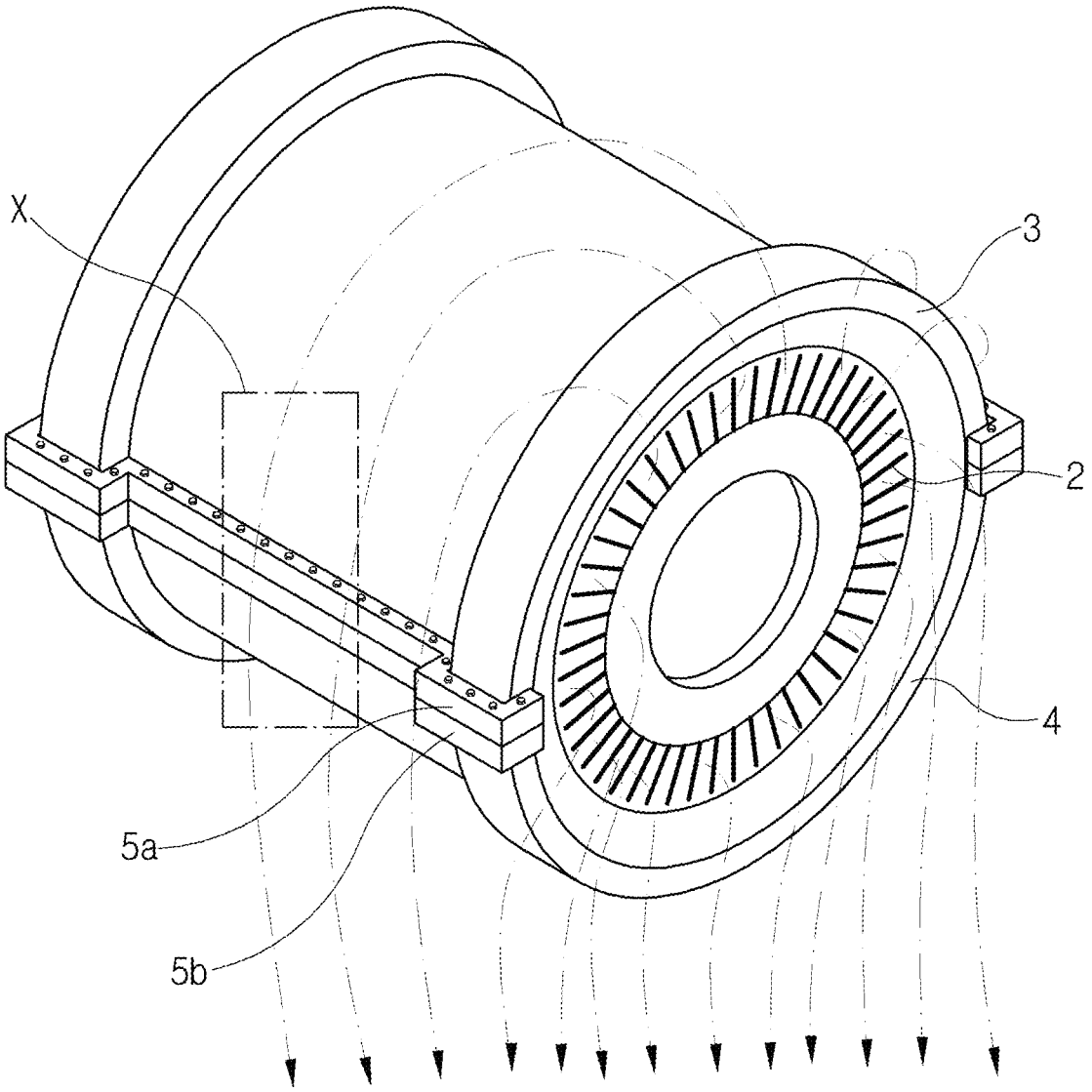
FIG. 1 is a view illustrating steam flow in a conventional casing.
Figure 2:
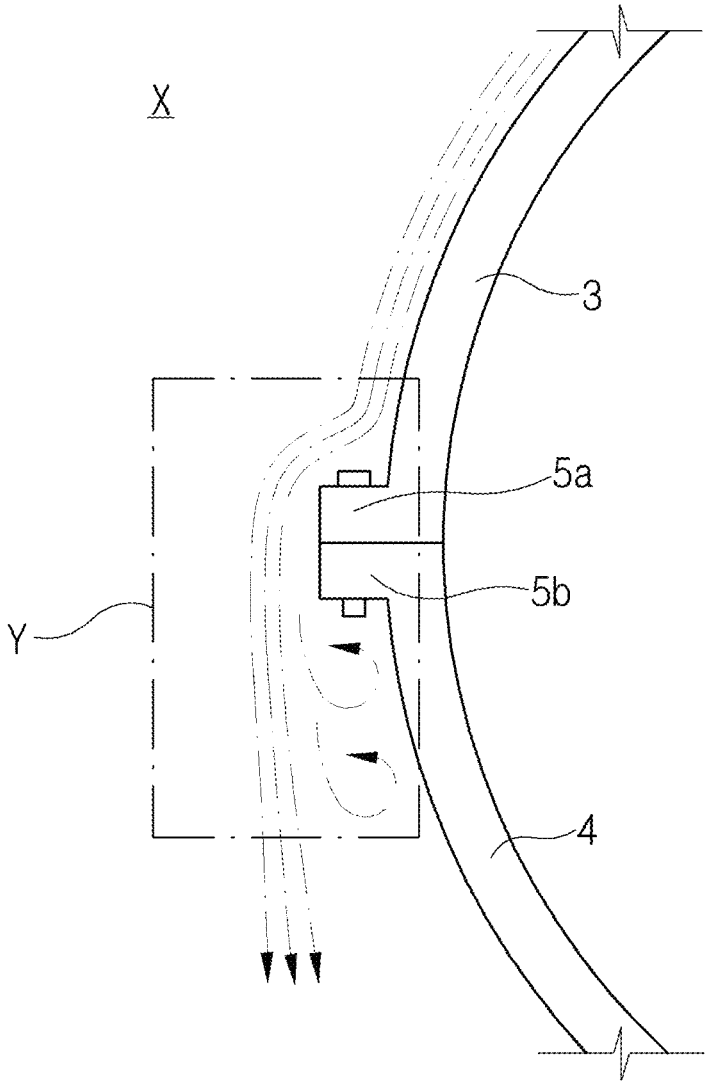
FIG. 2 is a view illustrating steam flow around a conventional casing flange.

Reference will now be made in detail to various exemplary embodiments, examples of which are illustrated in the accompanying drawings and described below. However, other forms may be embodied and should not be construed as limited to the embodiments set forth herein. The present disclosure is intended to cover not only the exemplary embodiments, but also various alternatives, modifications, equivalents, replacements and other embodiments, which may be included within the spirit and scope of the present disclosure as defined by the appended claims.

In the drawings, the thickness of each line or the size of each component may be exaggerated or schematically illustrated for convenience of description and clarity. In addition, the terms used in the specification are terms defined in consideration of functions in the present disclosure, and these terms may vary with the intention or practice of a user or an operator. Therefore, these terms should be defined based on the entire content disclosed herein.

Hereinafter, exemplary embodiments of a flow guide structure for a casing flange, and a casing and a turbomachine having the same will be described in detail with reference to the accompanying drawings.

Figure 3:
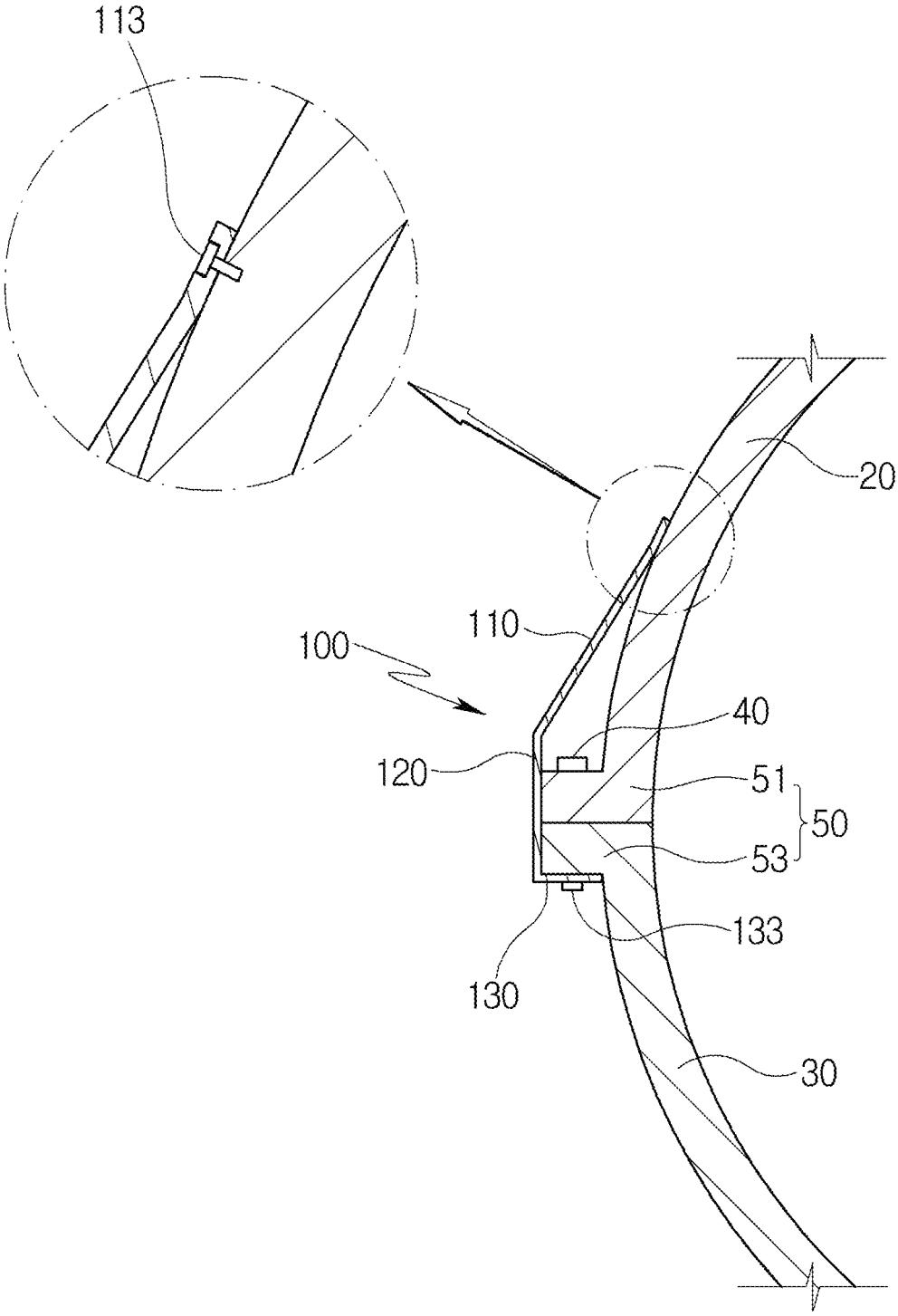
FIG. 3 is a view illustrating a first exemplary embodiment of a flow guide.

FIG. 3 is a view illustrating a first exemplary embodiment of a flow guide 100. Referring to FIG. 3, a flow guide structure for a casing flange according to an exemplary embodiment comprises a flow guide 100 positioned to seal a flange portion 50 connecting an upper casing 20 and a lower casing 30 and guiding fluid flow which flows adjacent to the flange portion 50.

The flow guide 100 comprise a flat portion 120, an inclined portion 110, and a bending portion 130. First, the flat portion 120 may be positioned close to outer end portions of flange 51 of the upper casing 20 and flange 53 of the lower casing 30. The flange portion 50 comprise the upper flange 51 and the lower flange 53. The upper flange 51 and the lower flange 53 may be coupled by a fastener 40.

The inclined portion 110 may be bent by a predetermined angle at an upper end of the flat portion 120 and connected to the upper casing 20 to guiding fluid flow which flows in a top-down direction. As shown in FIG. 3, the inclined portion 110 may be fixed to the upper casing 20 by fastening a bolt 113 into a fastening hole, which is formed on an upper side of the inclined portion 110. The fastening hole may be made in a groove shape not to disturb steam flow.

The bending portion 130 may be bent at a lower end of the flat portion 120. The bending portion 130 may be fixed to a lower end of the flange 53 of the lower casing 30 by bolt 133.

Due to the above structure, some steam, which is ejected, bypasses, and flows at the inner casing of the turbine as shown in FIG. 1, moves along the inclined portion 110, thus not receiving flow resistance at the upper end of the flange portion 50. That is, flow at the flange portion 50 of the inner casing becomes smoothed.

Figure 4:
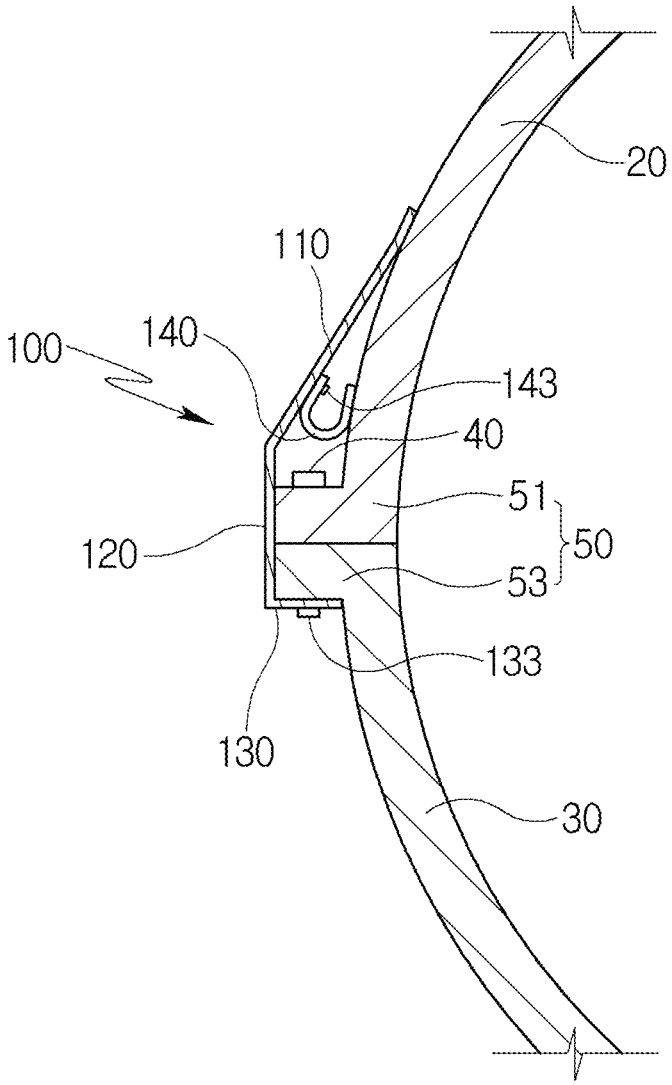
FIG. 4 is a view illustrating a second exemplary embodiment of the flow guide.

FIG. 4 is a view illustrating a second exemplary embodiment of the flow guide 100. Referring to FIG. 4, the second exemplary embodiment comprises the flow guide 100 comprising the flat portion 120, the inclined portion 110, and the bending portion 130. A buffering bar 140 is fixed to an inner surface of the inclined portion 110 by a fastening pin 143. Herein, the flat portion 120, the inclined portion 110, and the bending portion 130 are the same as those of the first exemplary embodiment and thus their descriptions will be omitted hereinafter.

The buffering bar 140 may be provided in a bending shape so that one end thereof is close to the inclined portion 110 and the other end is close to the upper casing 20. The buffering bar 140 may be made of a heat-resistance material having an elastic property such as a plate spring.

The buffering bar 140 pushes outwardly, due to elasticity, to prevent damage and deformation from pressure, which may occur at the inclined portion 110 due to vibration, shock and the like during operation of the turbine, or twist, deformation and the like of the inclined portion 110 due to thermal expansion.

Due to the above structure, some steam, which is ejected, bypasses, and flows at the inner casing of the turbine as shown in FIG. 1, moves along the inclined portion 110, thus not receiving flow resistance at the upper end of the flange portion 50. That is, flow at the flange portion 50 of the inner casing becomes smoothed. Further, the buffering bar 140 alleviates damage due to pressure, deformation due to thermal expansion and the like which may occur at the inclined portion 110 during operation of the turbine, thus constantly maintaining the inclined shape of the inclined portion 110 and stably guiding steam flow.

Figure 5:
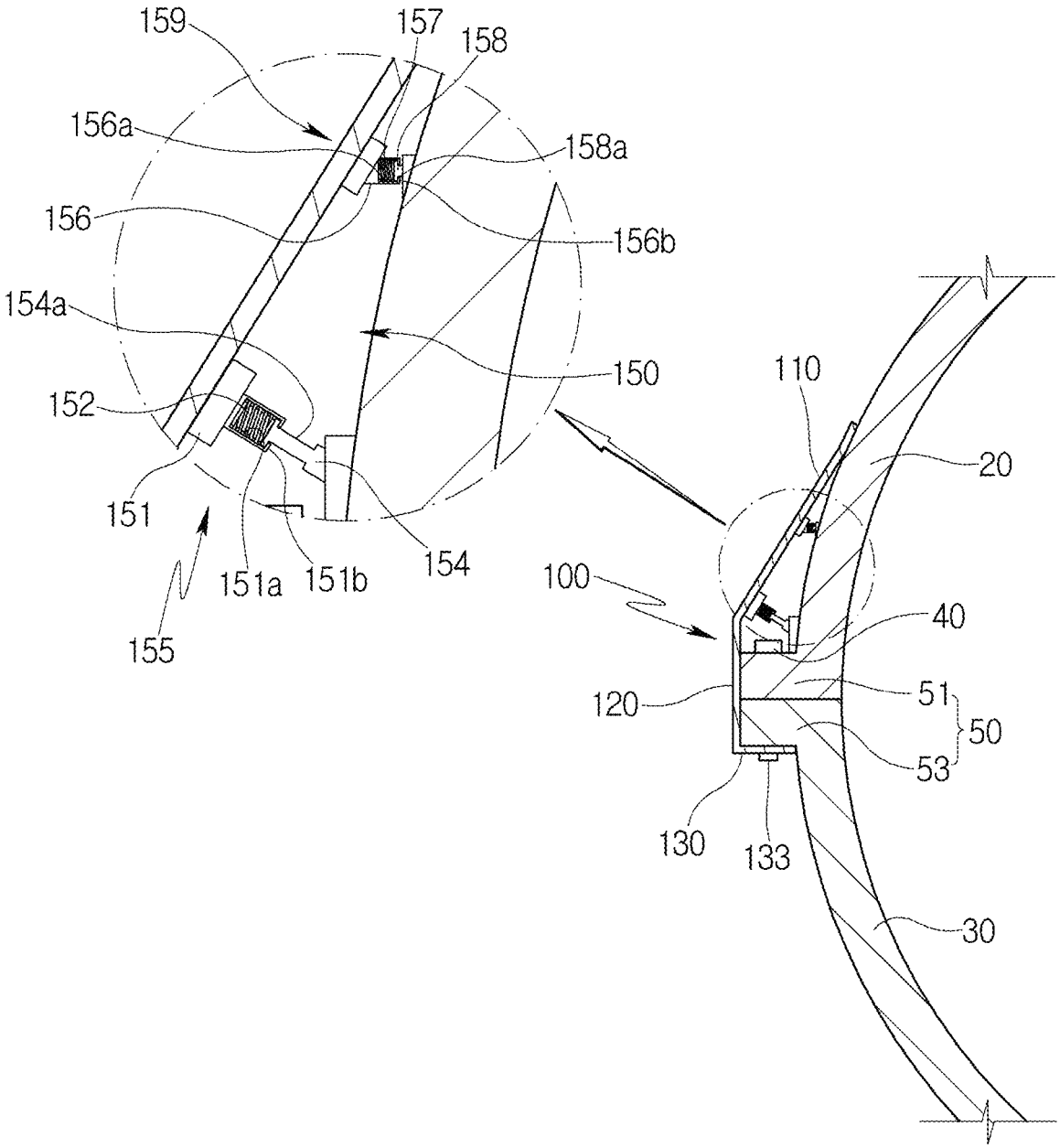
FIG. 5 is a view illustrating a third exemplary embodiment of the flow guide.

FIG. 5 is a view illustrating a third exemplary embodiment of a flow guide 100. Referring to FIG. 5, the third exemplary embodiment further comprises a supporting unit 150 interposed between the inclined portion 110 and the upper casing 20 to support the flow guide 100, which comprises the flat portion 120, the inclined portion 110, and the bending portion 130. Herein, the flat portion 120, the inclined portion 110, and the bending portion 130 are the same as those of the first exemplary embodiment and thus their descriptions will be omitted hereinafter.

The supporting unit 150 comprises a first supporting member 155 interposed between a lower portion of an inner surface of the inclined portion 110 and the upper casing 20, and a second supporting member 159 interposed between an upper portion of an inner surface of the inclined portion 110 and the upper casing 20. The first supporting member 155 may comprise a first upper side block 151, a first inner housing 151*a*, a first guide protrusion 151*b*, a first elastic body 152, and a first guide groove 154*a*.

First, the first upper side block 151 may be positioned at a lower end of the inner surface of the inclined portion 110. The first inner housing 151*a* may be formed inside thereof and the first guide protrusion 151*b* may be formed at an opening side of the first inner housing 151*a*. The first elastic body 152 may be positioned inside the first inner housing 151*a*.

The first lower side block 154 may be fixed to the upper casing 20 and positioned to connect with the first upper side block 151. The first guide groove 154*a* seating the first guide protrusion 151*b* may be formed at an outer side surface of the first lower side block 154.

The first elastic body 152 may be implemented as a coil spring shape. The first guide protrusion 151*b* can be adjusted along the first guide groove 154*a* by an elastic force of the first elastic body 152, thus alleviating damage due to pressure or deformation due to thermal expansion and the like, which may occur at the inclined portion 110 during operation of the turbine. The above function may be implemented together with the second supporting member 159.

The second supporting member 159 comprises a second upper side block 156, a second lower side block 158, a second inner housing 156*a*, a second guide protrusion 156*b*, a second elastic body 157, and a second guide groove 158*a*.

First, the second upper side block 156 may be positioned at an upper end of the inner surface of the inclined portion 110. The second inner housing 156*a* may be formed inside thereof and the second guide protrusion 156*b* may be formed at an opening side of the second inner housing 156*a*. The second elastic body 157 may be positioned inside the second inner housing 156*a*.

The second lower side block 158 may be fixed to the upper casing 20 and positioned to connect with the second upper side block 156. The second guide groove 158*a* seating the second guide protrusion 156*b* may be formed at an outer surface of the second lower side block 158

The second elastic body 157 may be implemented as a coil spring shape. The second guide protrusion 156*b* can be adjusted along the second guide groove 158*a* by an elastic force of the second elastic body 157, thus alleviating damage due to pressure or deformation due to thermal expansion and the like, which may occur at the inclined portion 110 during operation of the turbine.

Figure 6:
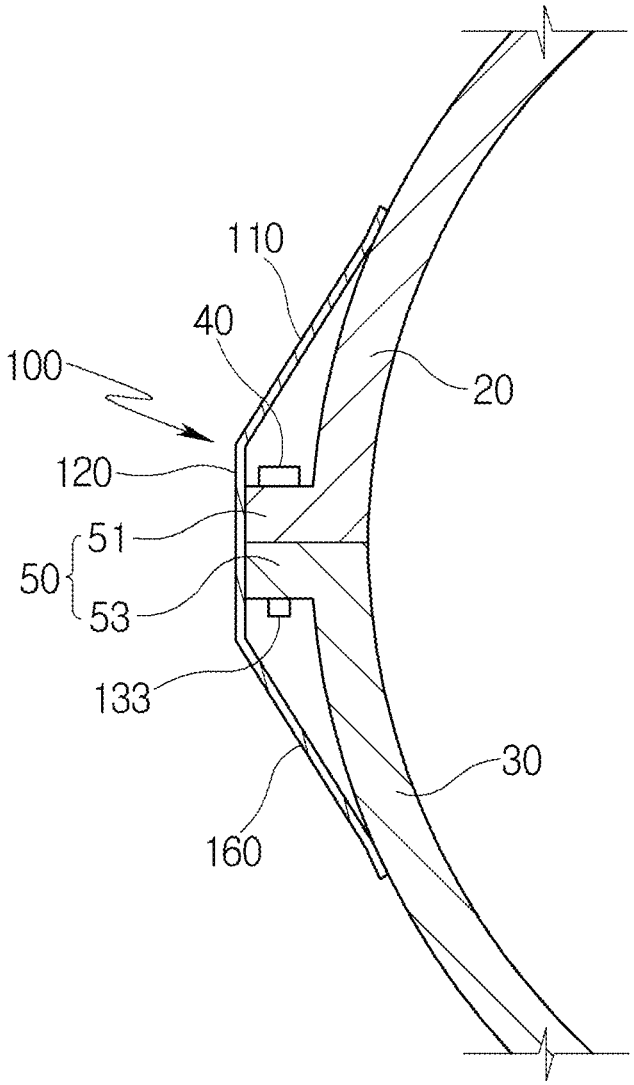
FIG. 6 is a view illustrating a fourth exemplary embodiment of the flow guide.

FIG. 6 is a view illustrating a fourth exemplary embodiment of a flow guide. Referring to FIG. 6, the fourth exemplary embodiment of the flow guide 100 comprises the flat portion 120, the inclined portion 110, and a slope portion 160.

First, the flat portion 120 may be positioned close to outer end portions of a flange 51 of the upper casing 20 and a flange 53 of the lower casing 30. The inclined portion 110 may be bent by a predetermined angle at an upper end of the flat portion 120, fixed to the upper casing 20, and guide fluid flow which flows in a top-down direction. The slope portion 160 may be bent by a predetermined angle at a lower end of the flat portion 120, fixed to the lower casing 30, and prevent occurrence of turbulence of fluid guided by the inclined portion 110.

Due to the above structure, some steam, which is ejected, bypasses, and flows at the inner casing of the turbine as shown in FIG. 1, moves along the inclined portion 110, thus not receiving flow resistance at the upper end of the flange portion 50. That is, flow at the flange portion 50 of the inner casing becomes smoothed. Further, steam moves along the slope portion 160 at the lower end of the flange portion 50, thus preventing turbulence of some steam at the lower flange 53.

Figure 7:
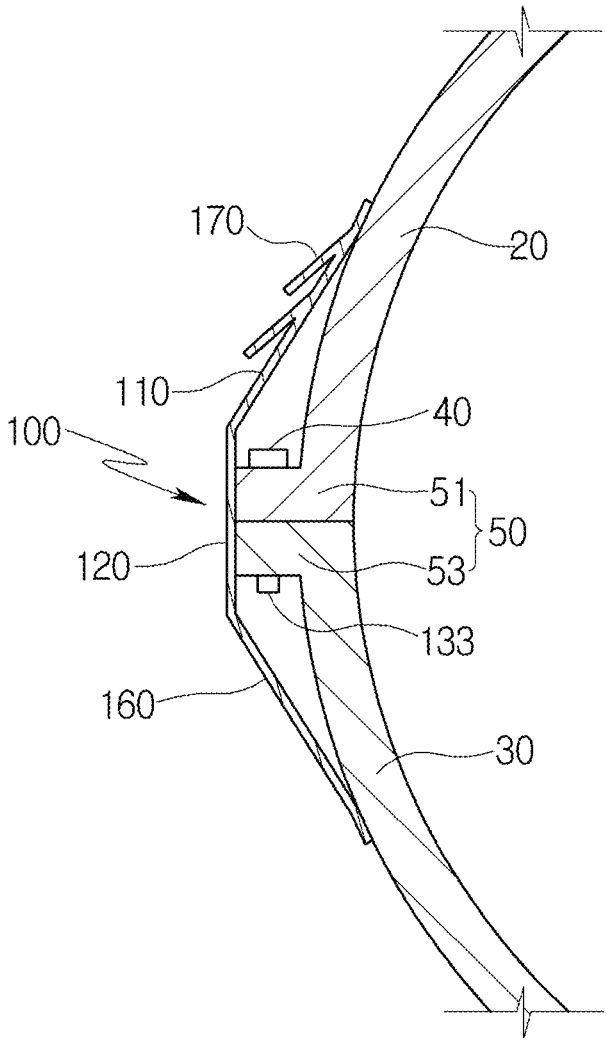
FIG. 7 is a view illustrating a fifth exemplary embodiment of the flow guide.

FIG. 7 is a view illustrating a fifth exemplary embodiment of a flow guide 100. Referring to FIG. 7, the fifth exemplary embodiment of the flow guide 100 comprises the flat portion 120, the inclined portion 110, the slope portion 160, and a guide wing portion 170.

First, the flat portion 120 is positioned close to outer end portions of the flange 51 of the upper casing 20 the flange 53 of the lower casing 30. The inclined portion 110 may be bent by a predetermined angle at the upper end of the flat portion 120, fixed to the upper casing 20, and guide fluid flow which flows in a top-down direction. The slope portion 160 may be bent by a predetermined angle at the lower end of the flat portion 120, fixed to the lower casing 30, and prevent occurrence of turbulence of fluid guided by the inclined portion 110.

Further, the guide wing portion 170 may be positioned at the inclined portion 110 to distribute fluid flow, which flows in a top-down direction, to an outer side of the flange portion 50. An inclined angle between the guide wing portion 170 and the inclined portion 110 may be determined within a range that does not affect steam flow by a component interposed between the inner casing and the outer casing. The guide wing portion 170 may be integrally positioned on the inclined portion 110 in a total longitudinal direction of the flange portion 50. In the alternative, a plurality of the guide wing portion 170 may be shortly divided by a constant interval and positioned along a longitudinal direction of the flange portion 50 on the inclined portion 110.

Due to the above structure, some steam, which is ejected, bypasses, and flows at the inner casing of the turbine as shown in FIG. 1, moves along the inclined portion 110, thus not receiving flow resistance at the upper end of the flange portion 50. That is, flow at the flange portion 50 of the inner casing becomes smoothed.

At this time, fluid flow is distributed to an outside by the guide wing portion 170, thus further reducing steam flow resistance. Further, steam moves along the slope portion 160 at the lower end of the flange portion 50, thus preventing turbulence of some steam at the lower end of the lower flange 53.

Figure 14:
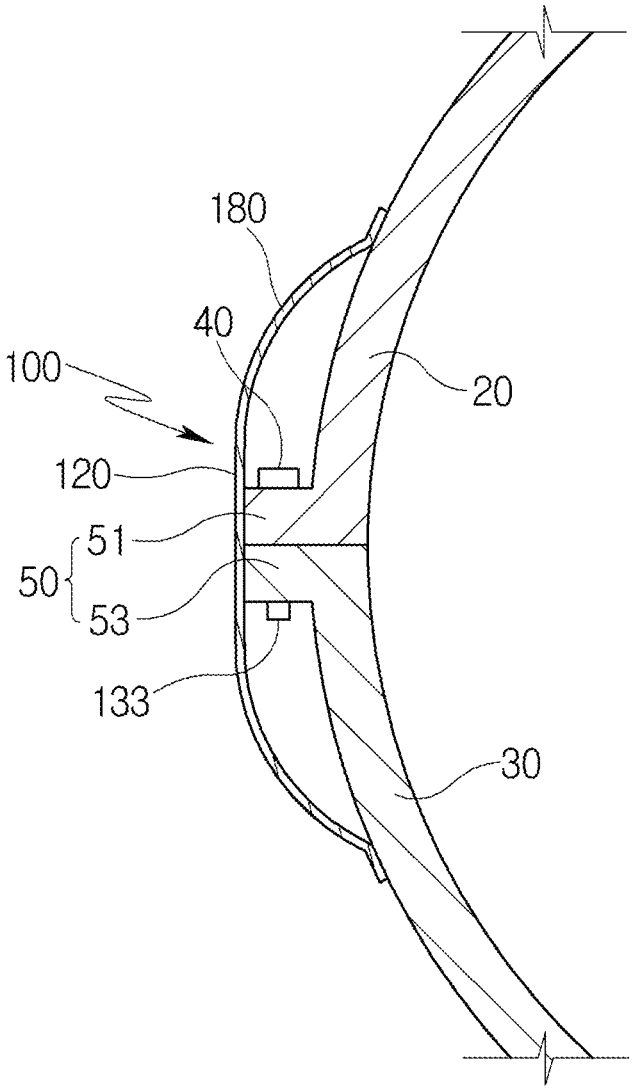
FIG. 14 is a view illustrating a sixth exemplary embodiment of the flow guide.

Referring to FIG. 14, a sixth exemplary embodiment of a flow guide 100 is shown. The flow guide 100 may comprise the flat portion 120 positioned close to the flange portion 50 and a curved portion 180 bent by a predetermined curvature at the upper and lower ends of the flat portion 120, fixed to the upper casing 20 and the lower casing 30, and guiding fluid flow which flows in a top-down direction. Fluid, which flows in a top-down direction due to the above shape, smoothly flows along the curve and goes over the flange portion 50, thus reducing flow resistance at the outer surface of the casing.

Hereinafter, experimental data of steam flow according to the first exemplary embodiment will be described.

Figure 8:
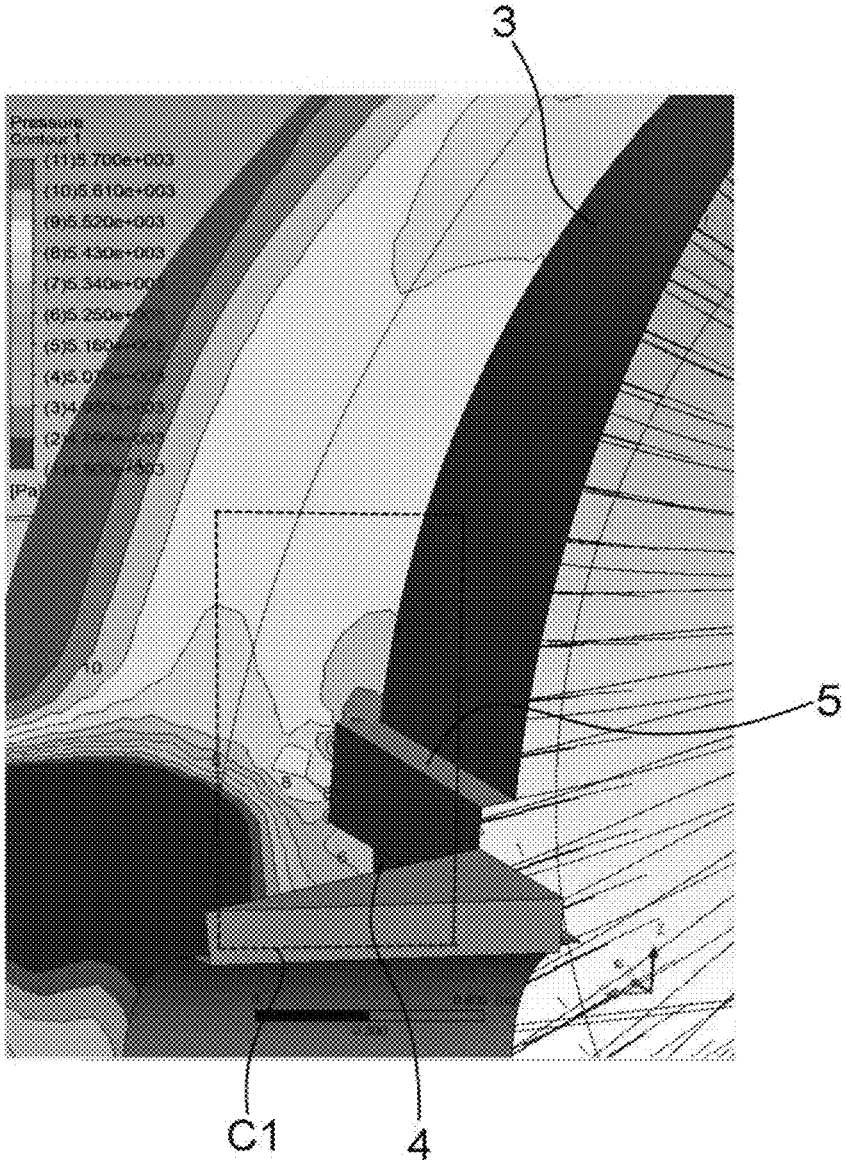
FIGS. 8 and 9 are views illustrating a steam pressure status around a casing flange depending on existence of the flow guide.
Figure 9:
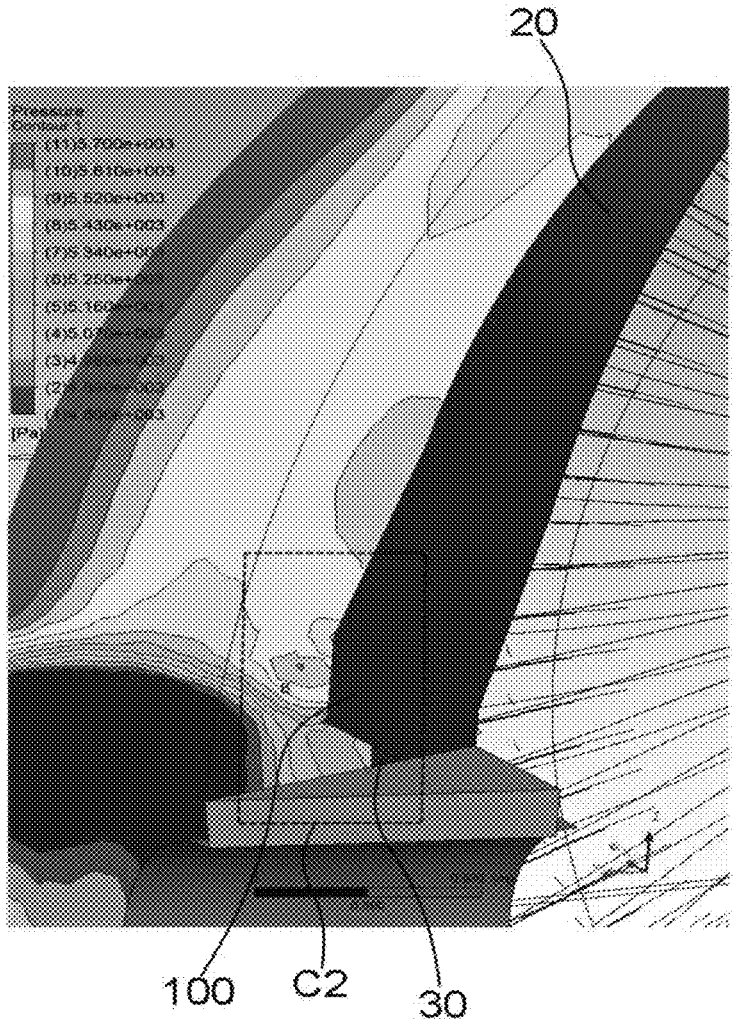
Figure 10:
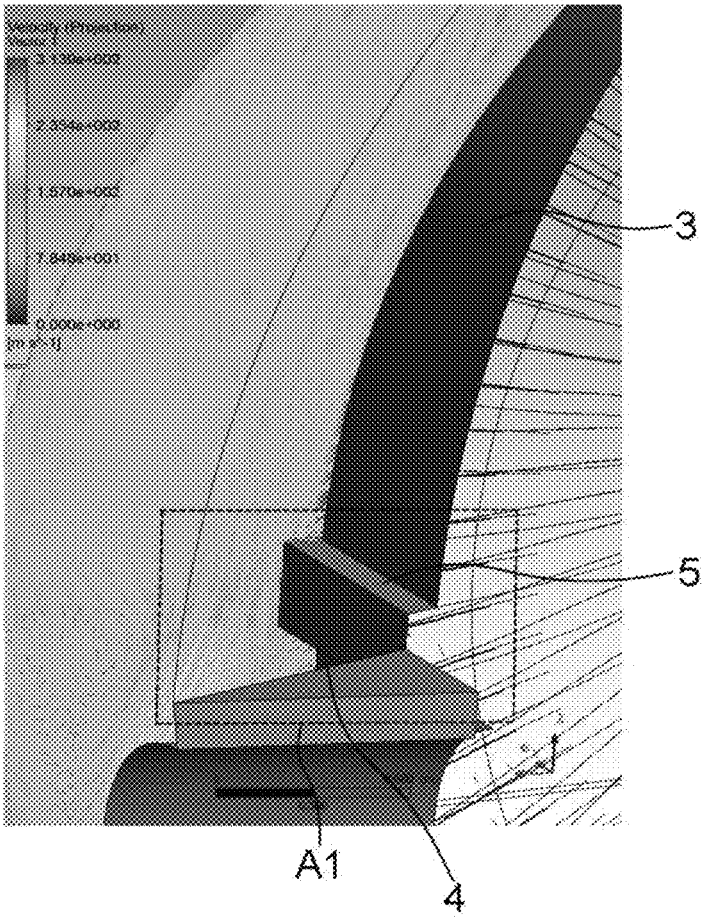
FIGS. 10 and 11 are views illustrating a steam velocity status around the casing flange depending on existence of the flow guide.
Figure 11:
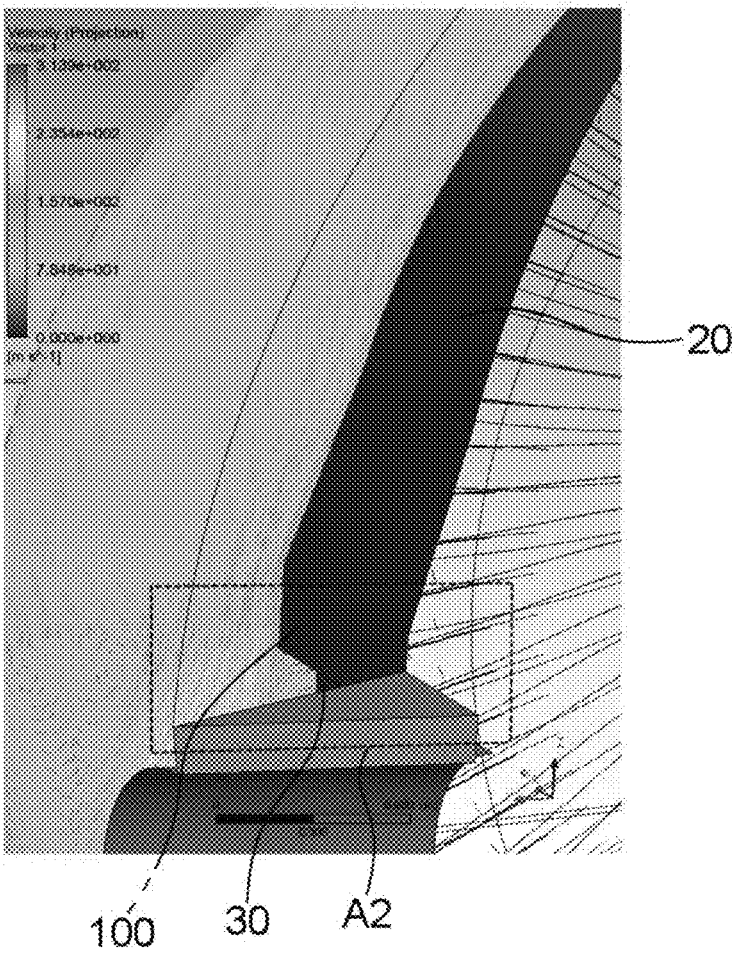
Figure 12:
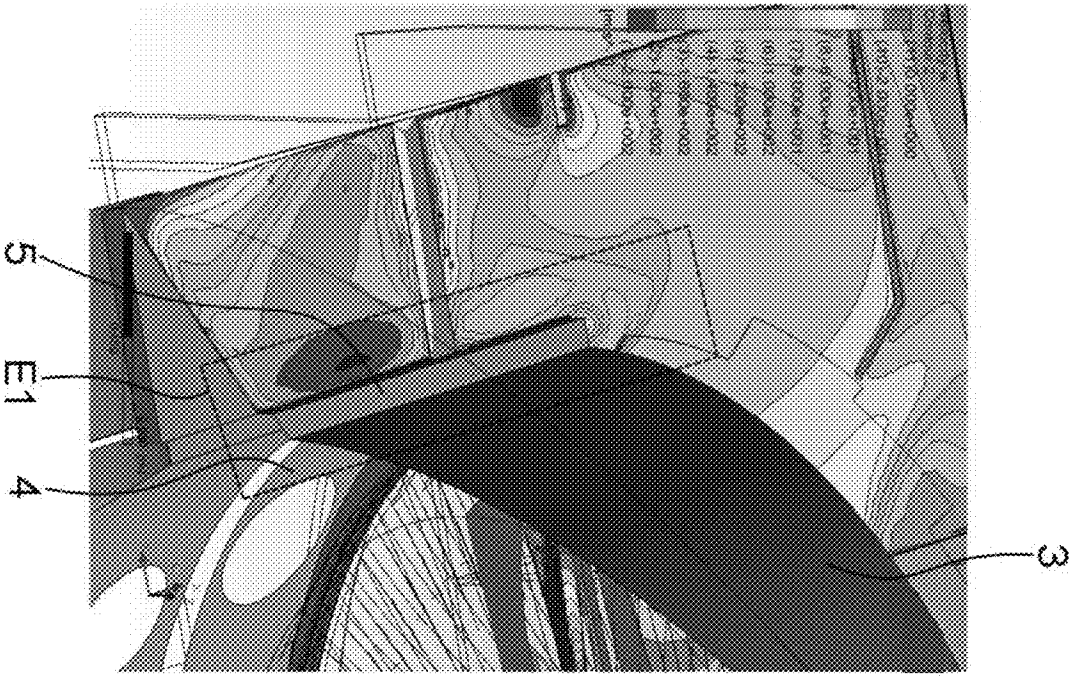
FIGS. 12 and 13 are views illustrating, at other points, the steam velocity status around the casing flange depending on existence of the flow guide structure.
Figure 13:
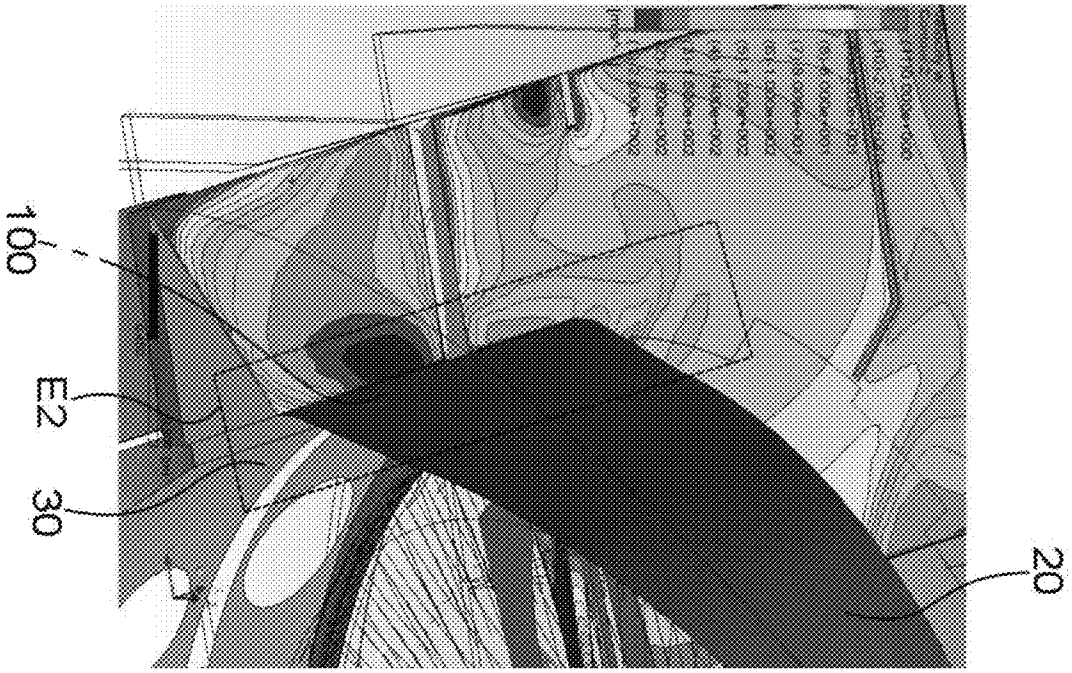

FIGS. 8 and 9 are views illustrating a steam pressure status around a casing flange depending on existence of the flow guide according to the present disclosure. FIGS. 10 and 11 are views illustrating a steam velocity status around the casing flange depending on existence of the flow guide according to the present disclosure. FIGS. 12 and 13 are views illustrating, at other points, the steam velocity status around the casing flange depending on existence of the flow guide according to the present disclosure.

Hereinafter, an input pressure value indicated in the drawings basically uses a unit of (Pa) and a velocity basically uses a unit of (m/s), but the value is arbitrarily set and it is not necessarily limited thereto and may have a different value depending on a turbine applied. In the present experiment, the darker red index becomes, the higher a pressure is, and the darker blue index becomes, the lower a pressure is. Likewise, in the present experiment, the darker yellow and red become, the more flow resistance of a fluid velocity vector receives, and the darker green and blue become, the less flow resistance of a fluid velocity vector receives.

Referring to FIGS. 8 and 9, in FIG. 8, when a flange portion 5 connected with an upper casing 3 and a lower casing 4 is exposed to steam flow at a stepped configuration, the steam flow receives much resistance at a stepped portion of an upper side of the flange portion 5, represented by a red index indicating resistance higher than a surrounding portion thereof. By comparison, referring to FIG. 9, the steam flows smoothly around the flow guide 100 covering the flange portion 50, represented by an orange index indicating resistance lower than a surrounding portion thereof as compared to in FIG. 8.

The steam flow flows in a little inclined direction at a portion where the inclined portion 110 starts, as represented by an orange index lighter than a surround portion thereof. However, dark orange or red index, which largely affects the steam flow, is reduced thus improving overall steam flow.

Referring to FIGS. 10 and 11, FIG. 10 shows that the flange portion 5 connected with the upper casing 3 and the lower casing 4 is exposed to steam flow at a stepped configuration, and thus the steam flow is largely bent and moves toward an outer side of the flange portion 5. An arrow indicates a velocity vector of the steam flow. Accordingly, it is shown that the steam flow passes through an upper portion of the flange 5 and then a fluid velocity of the steam rapidly reduces from a bluish green to a green or yellow index.

By comparison, in FIG. 11, the flow guide 100 is positioned to cover the flange portion 50 and the steam flow moves along the inclined portion 110, thus creating a smooth flow of velocity vectors. To this end, even if the steam flow reaches the flat portion 120 connected to the flange portion 50, it does not experience a rapid change in a fluid velocity. That is, it prevents a rapid change in the flowing direction of the steam, thus smoothing the steam flow at an outer surface of an inner casing.

Referring to FIGS. 12 and 13, in FIG. 12, the flange portion 5 connected with the upper casing 3 and the lower casing 4 is exposed to steam flow at a stepped configuration, and thus the steam flow is largely bent and moves toward an outer side of the flange portion 5. Accordingly, a fluid velocity of the steam rapidly reduces at the flange portion 5.

By comparison, referring to FIG. 13, it is shown that the flow guide 100 is positioned and the fluid velocity of the steam flow at the flange portion 50 is relatively faster than in FIG. 12. That is, it is confirmed that a blue region at a surrounding portion of the flow guide 100 is formed wider than in FIG. 12.

In the present experiment, the darker red becomes, the slower a fluid velocity is, and the darker blue becomes, the faster the fluid velocity is.

As shown by the above experimental data, the exemplary embodiments have the advantage in that when the flow guide 100 is positioned at the flange portion 50, the steam flow, which flows along an outer side circumference of the inner casing, does not receive resistance at the flange portion 50. Thus, the steam flow is smoothed, preventing a rapid change in a flowing direction, and resolving the problem which reduces the fluid velocity.

Figure 15:
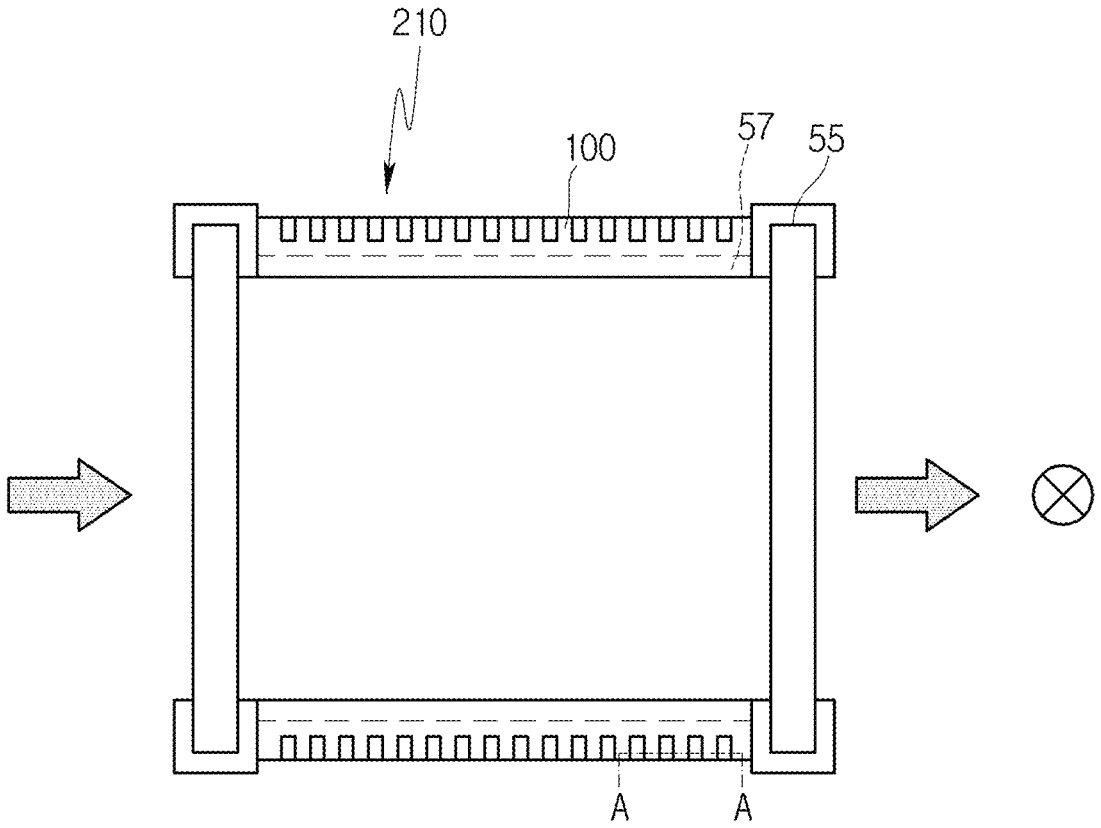
FIG. 15 is a view illustrating a direction groove according to an exemplary embodiment.
Figure 16A:
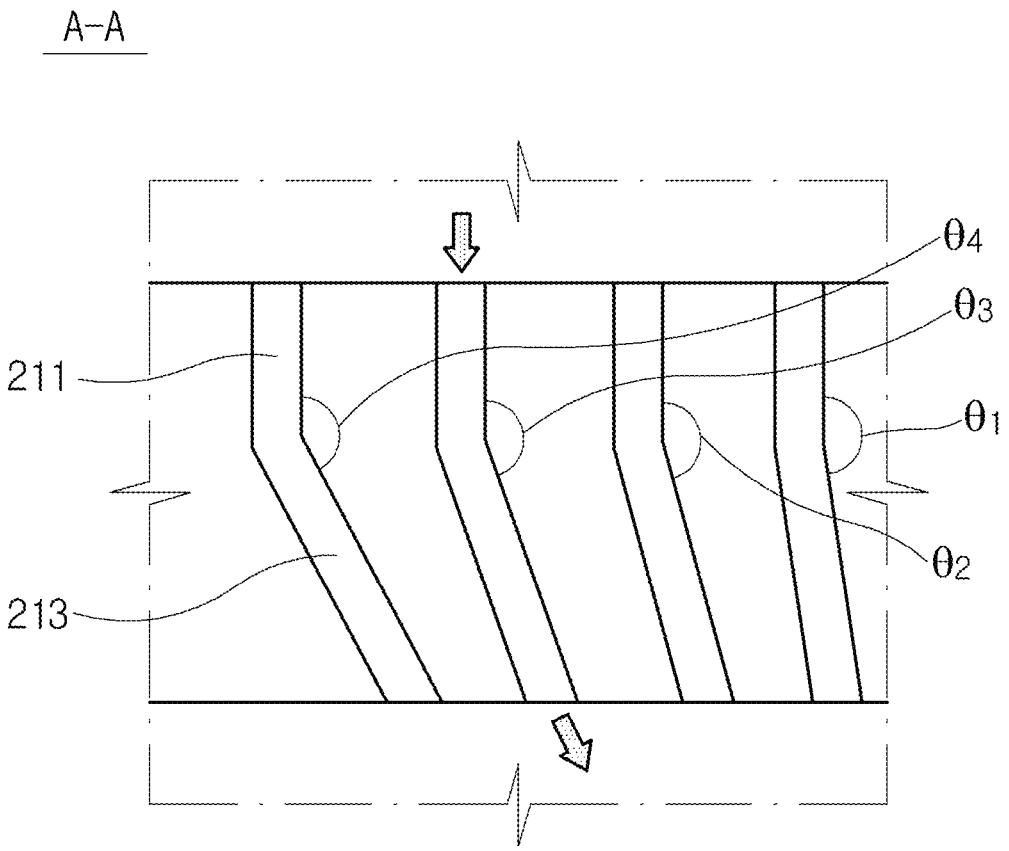
FIGS. 16*a* and 16*b* are views illustrating a detailed structure of the direction groove shown in FIG. 15.
Figure 16B:
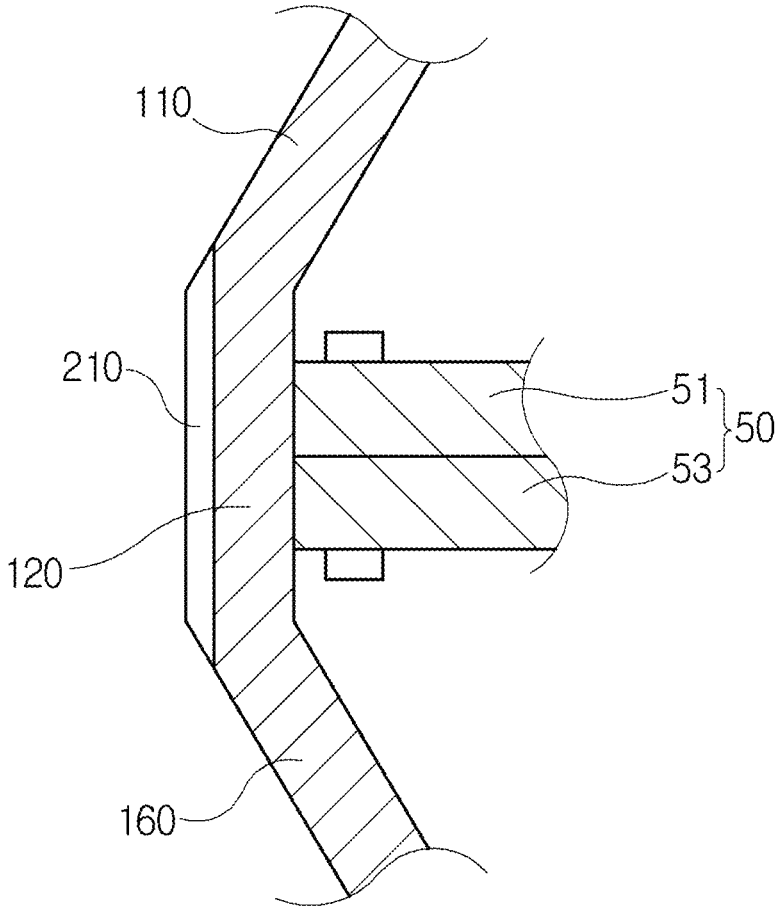
Figure 17:
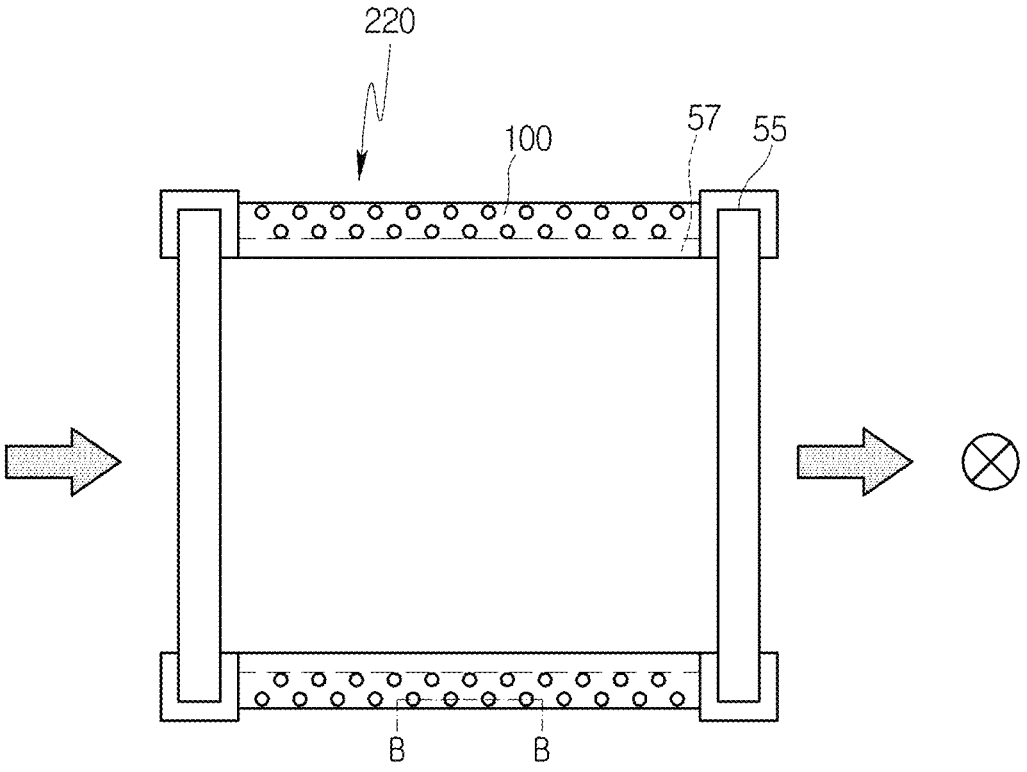
FIG. 17 is a view illustrating a direction hole according to an exemplary embodiment.

Referring to FIGS. 15 to 18, the flange portion 50 comprises a center flange portion 57 connecting a center portion of the inner casing, and a side flange portion 55 connecting both end portions of the inner casing. The flow guide 100 may be positioned at the center flange 57. Herein, FIGS. 15, 16*a*, and 16*b* show a structure of a direction groove 210 according to an exemplary embodiment, and FIGS. 17, 18*a*, and 18*b* show a structure of a direction hole 220 according to another exemplary embodiment.

First, referring to FIGS. 15, 16*a*, and 16*b*, the direction groove 210 may be formed to be spaced apart from a predetermined interval at an outer side of the flow guide 100 to guide fluid flow. The direction groove 210 may comprise a vertical groove portion 211 formed on an upper side of the flow guide 100 and moving fluid in a downward direction, and a bending groove portion 213 formed to connect with the vertical groove portion 211 at a lower side of the flow guide 100 and to change the fluid flow of moving in the downward direction.

The bending groove portion 213 is formed to face a fluid leakage direction at a turbomachine. The fluid is introduced into the vertical groove portion 211, and a direction thereof is changed at the bending groove portion 213, thus the fluid flows in the fluid leakage direction. At this time, a plurality of the direction grooves 210 are positioned along a longitudinal direction of the flow guide 100, and bending angles (θ1, θ2, θ3, θ4) between a plurality of the bending groove portions 213 may be differently configured.

As shown in FIG. 15, the fluid passes through an inner area of a casing in the arrow direction and when exiting in a ground direction (in a condenser direction of a low-pressure turbine among steam turbines), as shown in FIG. 16*a*, a bending angle is formed in a ground direction of a rear end of the casing where fluid exits, thus further smoothly guiding fluid flow in an outlet direction. Herein, the closer fluid leakage direction the direction groove 210 at the casing is, the smaller the bending angles (θ1, θ2, θ3, θ4) become. The purpose of the above is to maximize effect of direction change. FIG. 16*b* shows the direction groove 210 formed at the flat portion 120 of the flow guide 100.

Figure 18A:
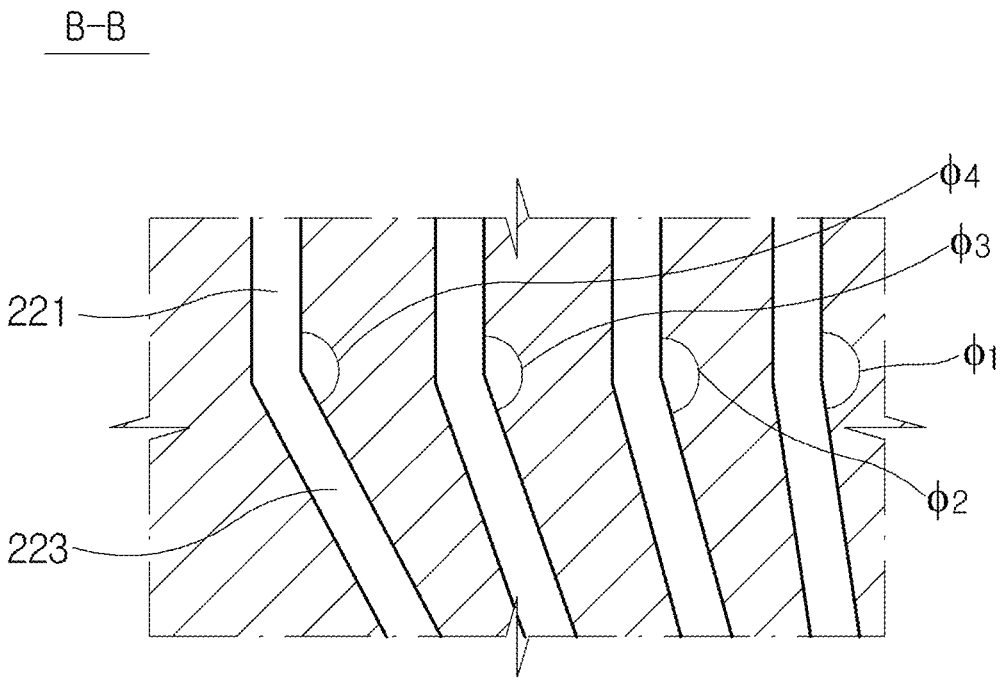
FIGS. 18*a* and 18*b* are views illustrating a detailed structure of the direction hole shown in FIG. 17.
Figure 18B:
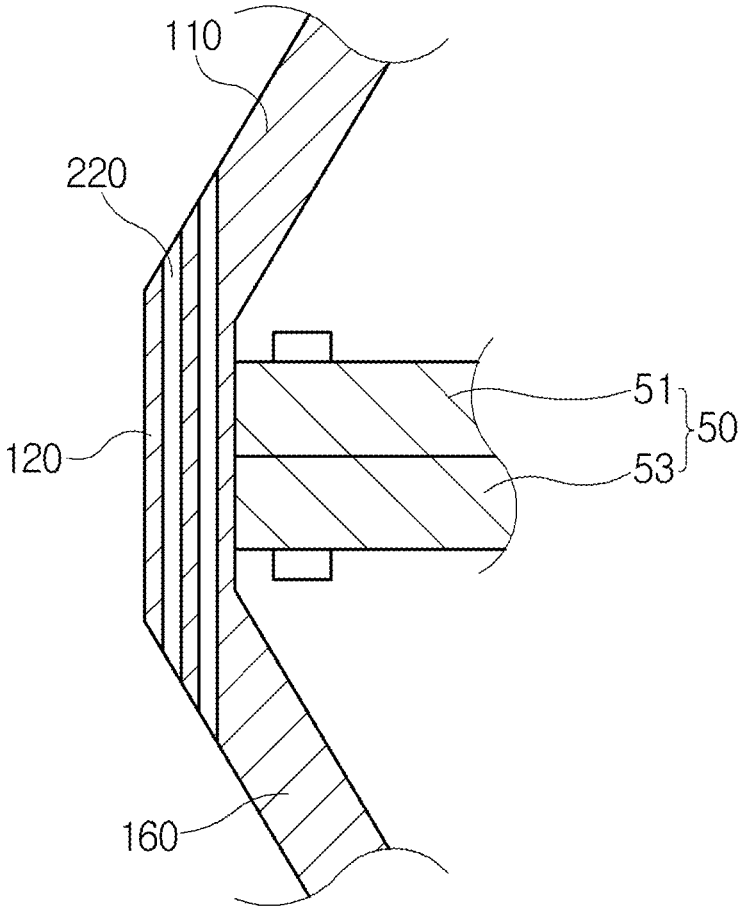

Referring to FIGS. 17, 18*a*, and 18*b*, the direction hole 220 may be formed to be spaced apart by a predetermined interval at an outer side of the flow guide 100 to guide fluid flow. The direction hole 220 may comprise a vertical hole portion 221 formed on an upper side of the flow guide 100 and moving fluid in a downward direction, and a bending hole portion 223 formed to connect with the vertical hole portion 221 at a lower side of the flow guide 100 and changing the fluid flow of moving in the downward direction. The bending hole portion 223 is formed to face a fluid leakage direction at a turbomachine. The fluid is introduced into the vertical hole portion 221, and a direction thereof is changed at the bending groove portion 223, thus the fluid flows in the fluid leakage direction. At this time, a plurality of the direction holes 220 are positioned along a longitudinal direction of the flow guide 100, and bending angles (Φ1, Φ2, Φ3, Φ4) between a plurality of the bending hole portions 223 may be differently configured.

As shown in FIG. 17, the fluid passes through an inner area of a casing in the arrow direction and when exiting in a ground direction (in a condenser direction of a low-pressure turbine among steam turbines), as shown in FIG. 18*a*, a bending angle is formed in a ground direction of a rear end of the casing where the fluid exits, thus further smoothly guiding fluid flow in an outlet direction. Herein, the closer fluid leakage direction the direction hole 220 at the casing is, the smaller the bending angles (Φ1, Φ2, Φ3, Φ4) become. The purpose of the above is to maximize effect of direction change. FIG. 18*b* shows the direction hole 220 is formed at the flat portion of the flow guide 100 by a multilayered structure.

Figure 19:
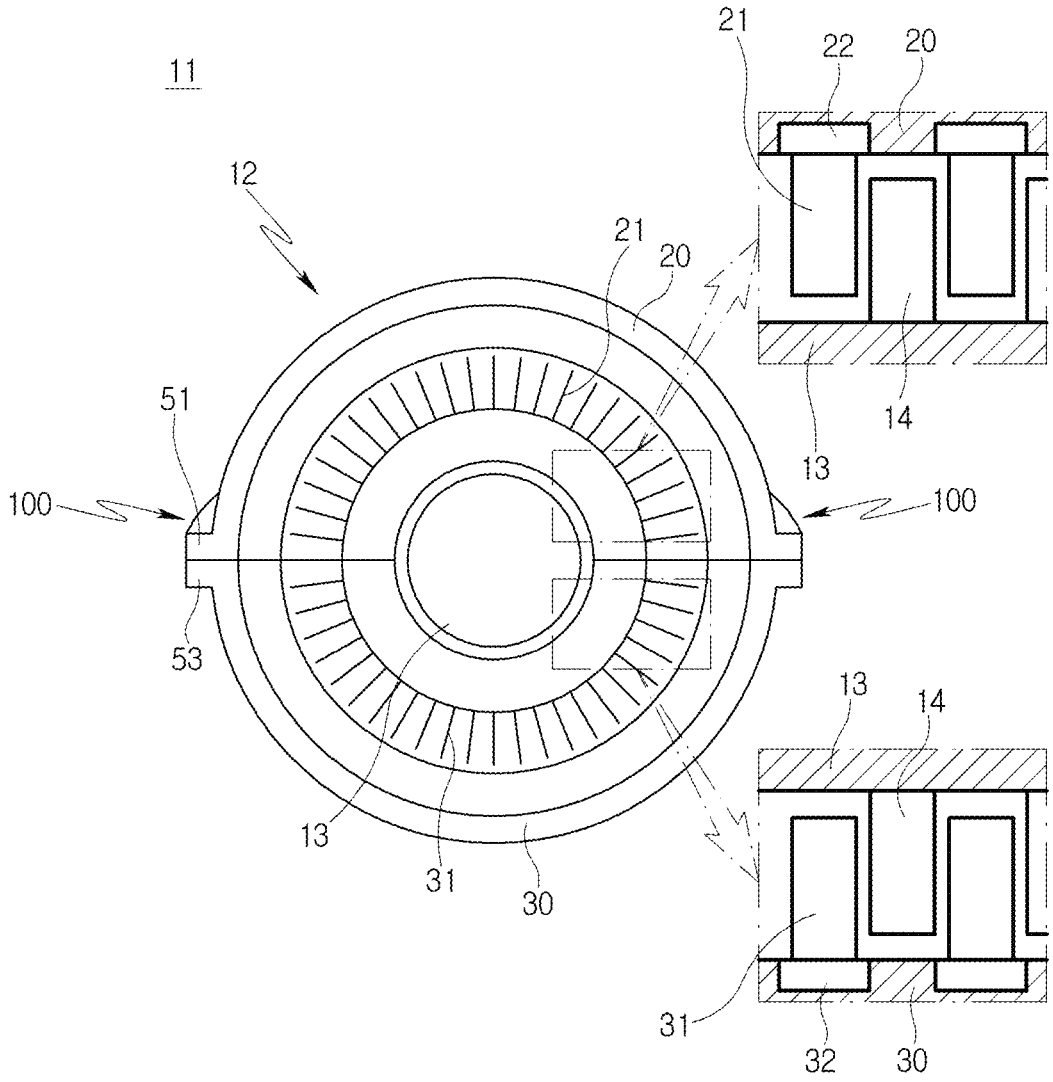
FIG. 19 is a view showing an exemplary embodiment of a casing and a turbo machine.

FIG. 19 shows an exemplary embodiment of a casing 12 for a turbomachine 11 according to the present disclosure. The upper casing 20 of an upper portion of the turbomachine 11 comprises the upper flange 51 positioned at an outer side portion and housing a plurality of diaphragms 22 arranged in a column and a plurality of vanes 21 mounted at an inner surface. The lower casing 30 of a lower portion of the turbomachine 11 comprises the lower flange 53 positioned at an outer side portion and housing a plurality of diaphragms 32 arranged in a column and a plurality of vanes 31 mounted at an inner surface. The flow guide 100 is positioned to surround the upper flange 51 and the lower flange 53.

Further, the turbomachine 11 according to the present disclosure comprise the casing 12 described above and a rotor 13 positioned at an inner area of the casing 12 and mounting a plurality of buckets 14 with the plurality of vanes 21, 31 alternatively arranged.

While the present disclosure has been described with respect to the specific exemplary embodiments, various changes and modifications may be made without departing from the spirit and scope of the disclosure as defined in the following claims.

What is claimed is:

1. A flow guide structure for a casing flange, comprising:

a flow guide includes a L-shaped portion configured to seal an upper flange of an upper casing and a lower flange of a lower casing, by connecting the upper flange of the upper casing and the lower flange of the lower casing of a turbomachine with a lower end of the L-shaped portion, and an inclined portion, formed to be extended from an upper end of the L-shape portion, configured to guide fluid to flow close to a flange portion comprising the upper flange and the lower flange, wherein the L-shaped portion includes a flat portion configured to be positioned close to outer end portions of the upper flange of the upper casing and the lower flange of the lower casing and the inclined portion, and a bending portion, formed at the lower end of the L-shaped portion, configured to be fixed to a lower end of the lower flange of the lower casing, and be bent to be perpendicular to the flat portion.

2. The flow guide structure according to claim 1, wherein the inclined portion is bent by a predetermined angle at an upper end of the flat portion and is connected to the upper casing to guide the fluid to flow in a top-down direction, and the inclined portion is fixed to the upper casing by fastening a bolt into a fastening hole formed on an upper side of the inclined portion and has a groove shape recessed inwardly.

3. The flow guide structure according to claim 2, wherein the bending portion is bent at a lower end of the flat portion and includes a hole through which the L-shaped portion of the flow guide is fixed to a lower end of the lower flange of the lower casing by a bolt.

* * * * *